US005997015A

United States Patent [19]

Bellehumeur

[11] Patent Number: 5,997,015

[45] Date of Patent: Dec. 7, 1999

[54] BRAKE FOR INLINE SKATES

[76] Inventor: Alex R. Bellehumeur, 6242 Napoli Ct., Long Beach, Calif. 90803

[21] Appl. No.: 09/006,651

[22] Filed: Jan. 14, 1998

[51] Int. Cl.[6] ..... A63C 17/14

[52] U.S. Cl. ..... 280/11.2

[58] Field of Search ..... 280/11.2, 842

[56] References Cited

U.S. PATENT DOCUMENTS

| | | | |
|---|---|---|---|
| 5,232,231 | 8/1993 | Carlsmith | 280/11.2 |
| 5,351,974 | 10/1994 | Cech | 280/11.2 |
| 5,755,449 | 5/1998 | Pozzobon | 280/11.2 |
| 5,758,884 | 6/1998 | Flater | 280/11.2 |
| 5,848,796 | 12/1998 | Meibock et al. | 280/11.22 |
| 5,924,704 | 7/1999 | Johnson | 280/11.2 |
| 5,927,728 | 7/1999 | Gignoux et al. | 280/11.2 |

*Primary Examiner*—Kevin Hurley
*Attorney, Agent, or Firm*—Edgar W. Averill, Jr.

[57] ABSTRACT

A brake assembly for roller skates. The brake assembly operates on two inline wheels which have a brake drum extending outwardly from them. The brake member is pivotally held so that it contacts the brake drums on the two inline wheels. The brake may be activated by a mechanical link attached to a pivoted horseshoe shaped device surrounding the ankle portion of the skate. Alternatively, it may be electrically activated by a potentiometer which may either be moved by the rearward movement of the skater's ankle, or by the rearward movement of the skater's toe.

2 Claims, 5 Drawing Sheets

3B
3C
7
10
11
12
13
14
15
16
17
18
19
20
21
22
23
24
25
26
27
28
29
30
31
32
33
34
35

BRAKE FOR INLINE SKATES

BACKGROUND OF THE INVENTION

The field of the invention is brakes for roller skates and more particularly for roller skates of the type referred to as inline skates. Numerous devices have been tried for assisting in the braking of inline skates. The most common brake is a pad which rubs against the skating surface when the skater tips his skate rearwardly. A brake of this type is shown in U.S. Pat. No. 5,564,718. Since the braking effect is very dependent upon the skating surface, such brakes are not completely reliable. Furthermore, some skating surfaces are very abrasive and the brakes can quickly wear.

Applicant has devised a toe activated brake which is the subject of U.S. Pat. No. 5,609,346. This brake utilizes the downward and rearward movement of the toe to activate a brake which rubs against the wheel.

The Zorzi, et al. U.S. Pat. No. 5,505,469 shows a braking device activated by a quarter which is pivotally attached to the shoe. As the quarter rotates rearwardly a cable is activated which in FIGS. 1 and 2 tilts a block into contact with the skating surface. In FIGS. 3, 4, 5 and 6 the cable activates the movement of a braking pad 332 against the hub, and in FIGS. 7 through 12 the quarter may be moved either rearwardly or forwardly to cause a braking element to rub against the tire portion of the wheel.

A pair of disks rub against the rear two wheels of an inline roller skate in U.S. Pat. No. 5,639,104. This rubbing results when the skater displaces his or her weight backwards.

None of these braking systems has found wide application and an improved brake design is needed.

BRIEF SUMMARY OF THE INVENTION

It is an object of the present invention to provide a smooth and easily controlled braking system for roller skates and in particular, for inline type roller skates.

The present invention is for a brake assembly for roller skates. The assembly has a wheel supporting frame holding at least two rotatable wheels aligned in a direction of travel. A brake member is movably held by the frame and has a curved forward brake surface and a curved rear brake surface and an actuated arm. A forward and a rear brake drum member is held to the two rotatable wheels and the brake drum members are oriented to contact the brake member when the brake member is moved by contact with its actuated arm. The brake may be moved by the use of a potentiometer and servo motor powered by batteries. The potentiometer may be moved by rotating a generally horseshoe shaped member rearwardly or by moving the skater's toe rearwardly to move a toe rest plate connected to the potentiometer.

DESCRIPTION OF THE PREFERRED EMBODIMENTS

Figures 1, 2, 3A, 3B, 3C:
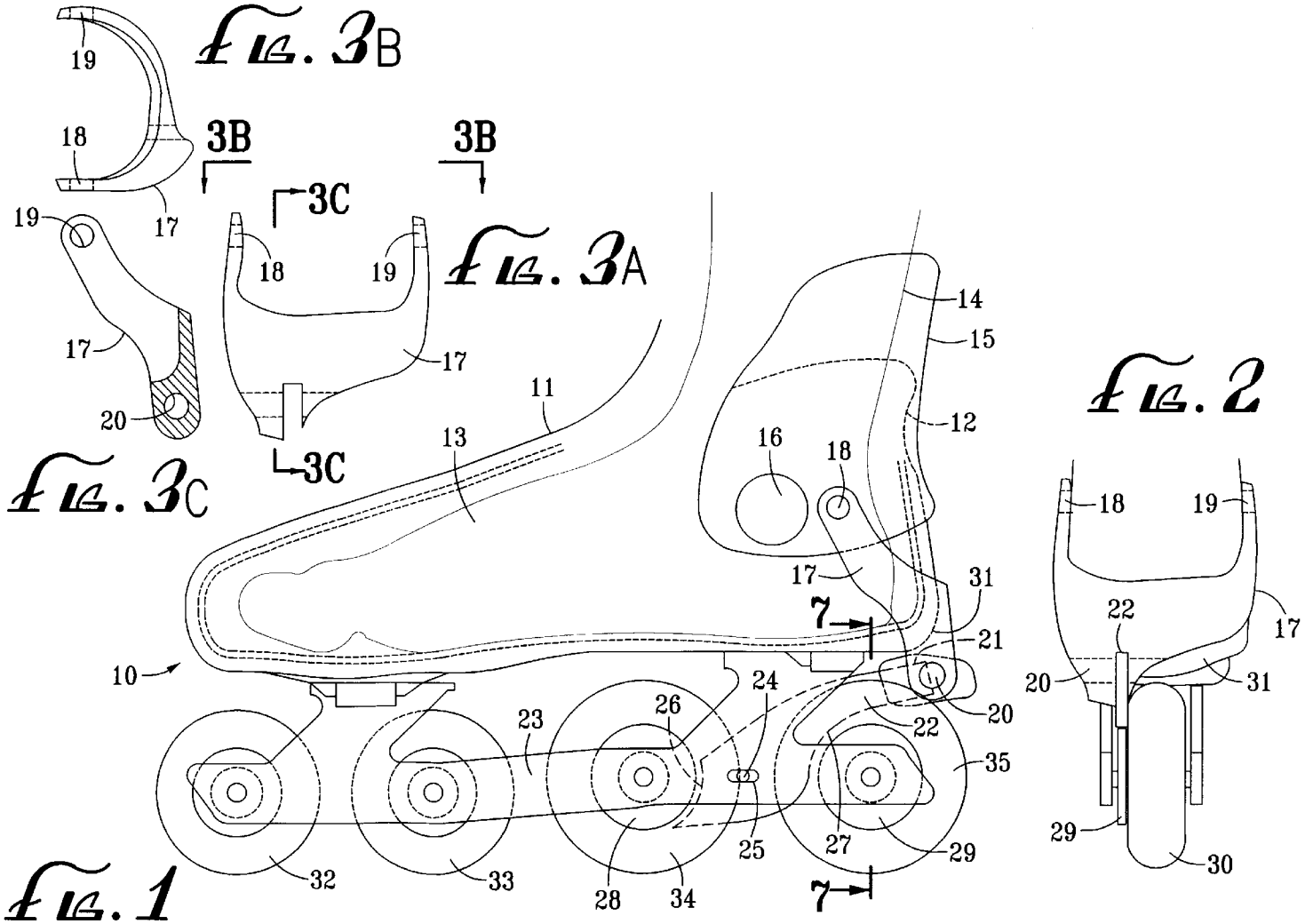
FIG. 1 shows a side view of an inline roller skate partly in cross-section utilizing a mechanically activated brake system.
FIG. 2 is a rear view of the inline skate containing the braking system of the present invention.
FIG. 3A shows a top view of the link of the mechanical braking system shown in FIG. 1.
FIG. 3B is a view taken along line 3B—3B of FIG. 3A.
FIG. 3C is a cross-sectional view taken along line 3C—3C of FIG. 3A.

An inline roller skate is shown in side view in FIG. 1 and indicated generally by reference character 10. Skate 10 has a boot portion 11 which has an ankle surrounding portion 12. A wearer's foot 13 is shown in boot portion 11 and includes the lower portion 14 of the wearer's leg. A generally horseshoe shaped member 15 surrounds the ankle surrounding portion 12 of boot portion 11. It is pivotally held to boot portion 11 at a pivot point 16. A pivot point 16 is positioned on each side of boot portion 11 and allows the generally horseshoe shaped member to pivot back and forth when the user moves the lower portion 14 of his leg rearwardly or in a forward direction.

A link 17 is pivotally connected at two pivot points 18 and 19 at its upper end and at a lower pivot point 20 to actuated arm 21 of brake member 22.

Brake member 22 is held to wheel supporting frame 23 by a pivot member 24. Pivot member 24 rides in a slot 25 on brake member 22. Brake member 22 has a curved forward brake surface 26 and a curved rear brake surface 27. Forward brake surface 26 abuts a forward brake drum member 28 and rear surface 27 contacts a rear brake drum member 29. Rear brake drum member 29 is shown in rear view in FIG. 2 and can be seen to extend outwardly past tire 30. The construction of the brake drum and its manner of securement to the wheel is shown best in FIGS. 7, 8 and 9. Brake member 22 is self-seating since it can move slightly in a forward direction or a rearward direction by the play between pivot member 24 and slot 25. As the skater moves the lower portion 14 of his leg, it contacts generally horseshoe shaped member 15 which pivots about the two pivot points 16. This moves the second pivot points 18 and 19 downwardly which in turn moves the actuated arm 21 downwardly bringing curved forward brake surface 26 and curved rear brake surface 27 into contact with the respective brake drum members 28 and 29. This smoothly and in a highly controlled manner causes the two rear wheels to be braked slowing the skater. Of course, the brake and brake drum assembly can be placed on both sides of wheels 34 and 35.

Link 17 is shown in detailed view in FIGS. 3A, 3B and 3C where it can be seen to surround the lower heel portion 31 of boot portion 11.

Figures 4A, 4B:
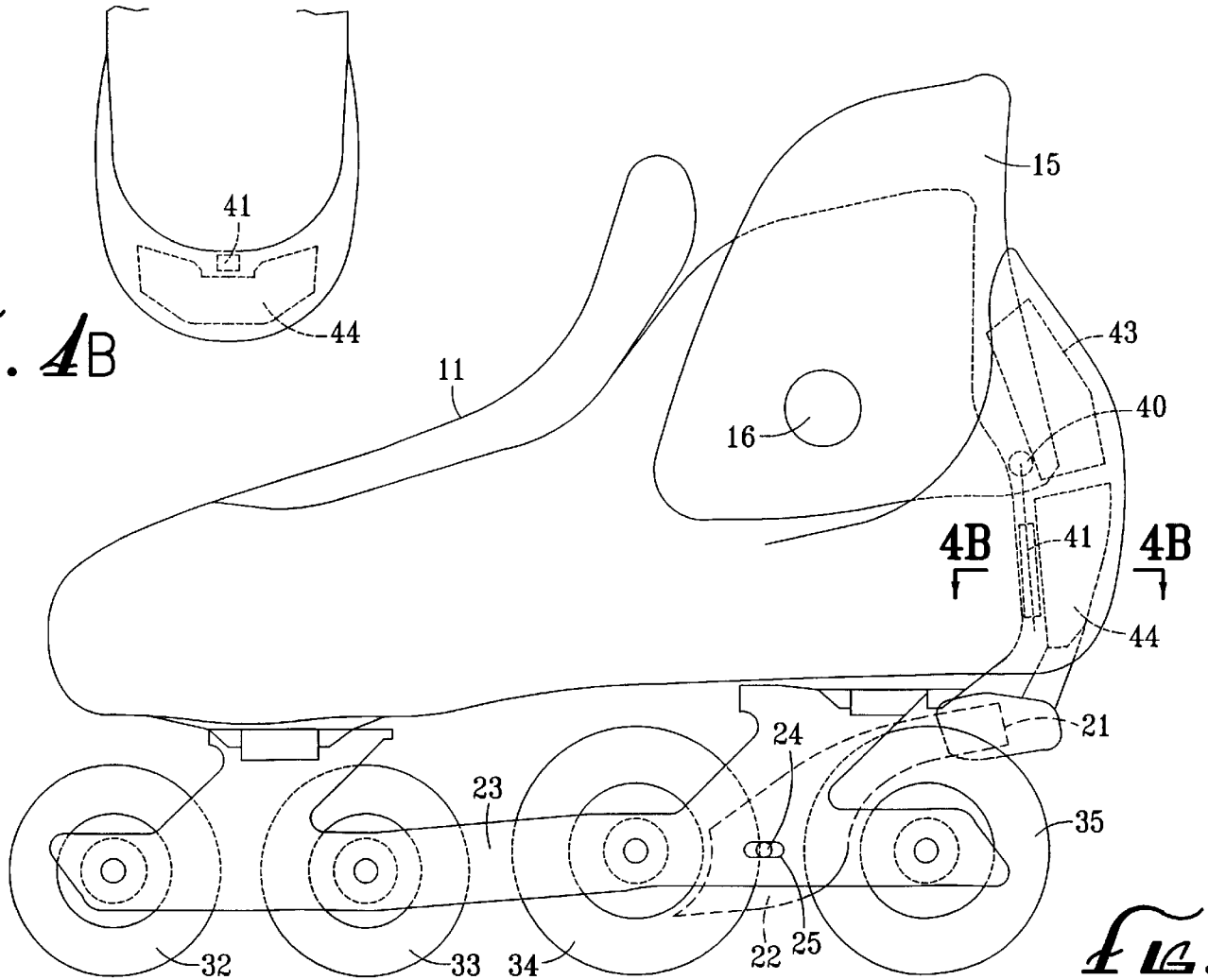
FIG. 4A is a side view of an inline skate utilizing an electrically operated braking element.
FIG. 4B is a cross-sectional view taken along line 4B—4B of FIG. 4A.

While the mechanical version of the brake as shown in FIG. 1 is effective, the braking power can be increased by providing an electrically activated brake as shown in FIGS. 4A and 4B. The same wheel supporting frame 23 and wheels 32, 33, 34 and 35 are shown as are present on the apparatus of FIG. 1. Boot portion 11 and generally horseshoe shaped member 15 are also shown both in FIGS. 1 and 4A. A second pivot point is present on the generally horseshoe shaped member 15 and this is connected to a link controlling potentiometer 41 which through a controller card not shown in FIG. 4A but shown diagrammatically in FIG. 10 and indicated by reference character 42 controls the output of battery pack 43 to servo motor 44. Servo motor 44 is linked to actuated arm 21 and operates the brake in the same manner as described above. This permits a lesser movement of the wearer's lower leg to provide control of the brake assembly.

Figure 5:
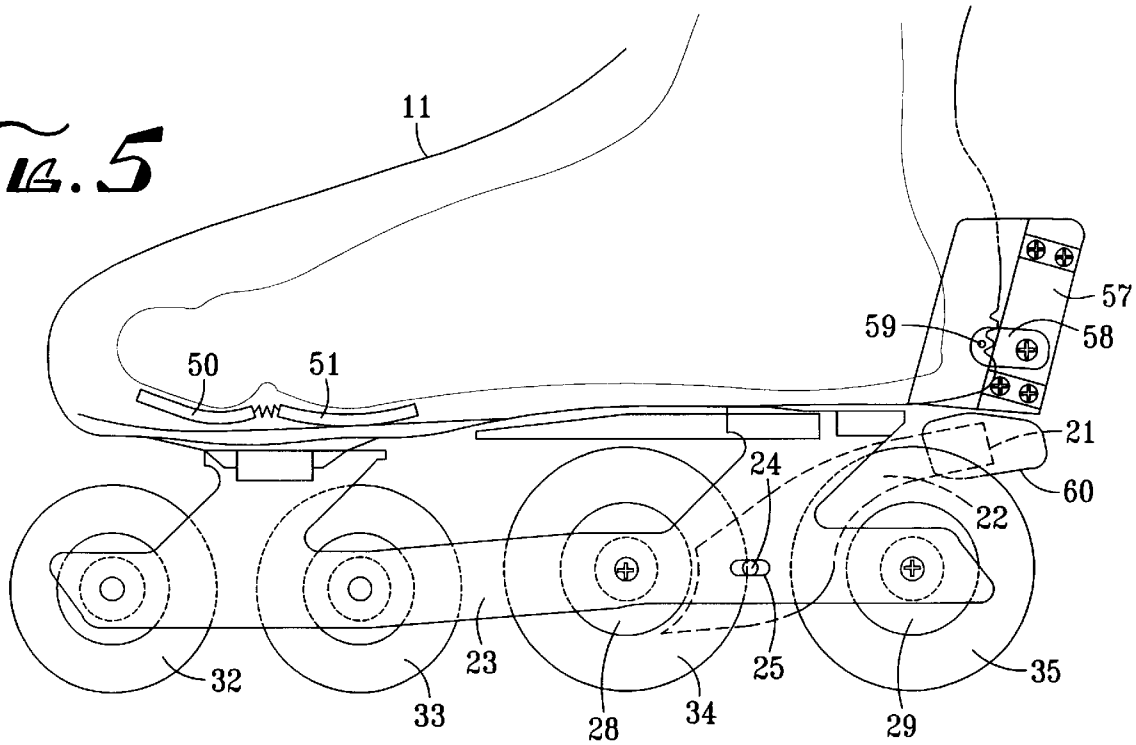
FIG. 5 is a side view of an inline roller skate having an electrically operated brake operated by the skater's toe.
Figure 6:
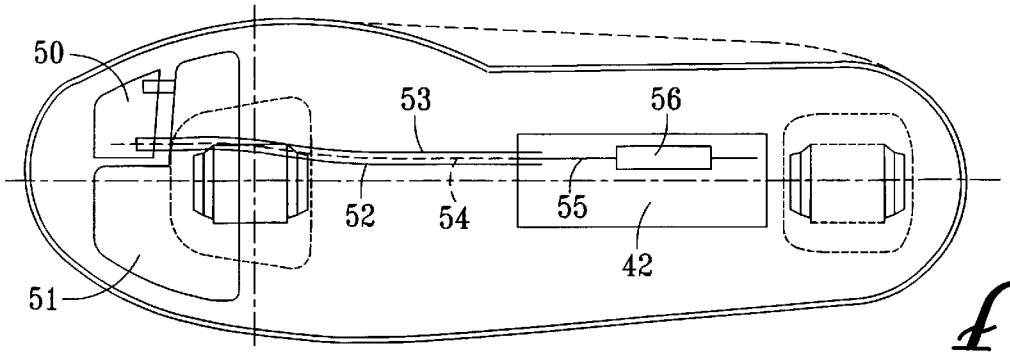
FIG. 6 is a cross-sectional view showing the underside of the shoe portion and a portion of the frame of the brake of FIG. 5.

The potentiometer may be moved by the skater's toe rather than his lower leg as shown in FIGS. 5 and 6. As shown in FIG. 6, a slidable toe rest plate 50 is held by a foot rest plate 51. A link 52 comprises a sheath 53 and a cable 54. As the wearer moves his toe rearwardly, cable 54 moves rearwardly and is directly connected to the control cable 55 of potentiometer 56. The controller card 42 converts the output of potentiometer 56 to battery pack and servo motor 57 shown in FIG. 5. Battery pack and servo motor 57 has an output link 58 which is pivoted by serve motor 57 and is linked at pivot point 59 to boot portion 11. This causes the battery pack and servo motor 57 to move downwardly and contact pad 60 which surrounds activated arm 21. The downward movement of activated arm 21 operates brake member 22 in the same manner as described above.

Figure 7:
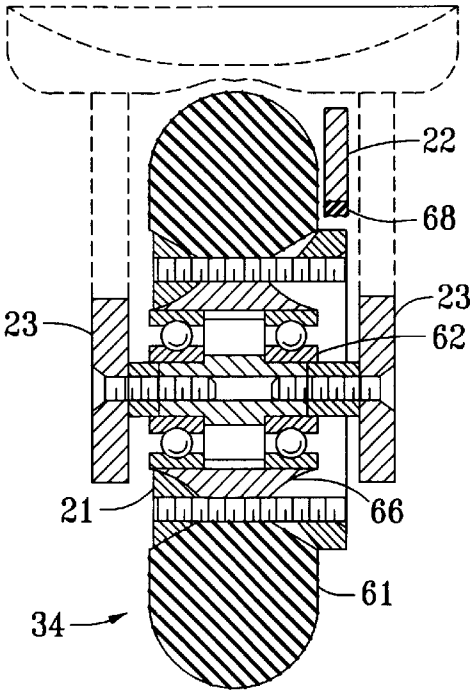
FIG. 7 is a cross-sectional view of a wheel, brake drum, and brake lever of the brake of FIG. 1.
Figure 8:
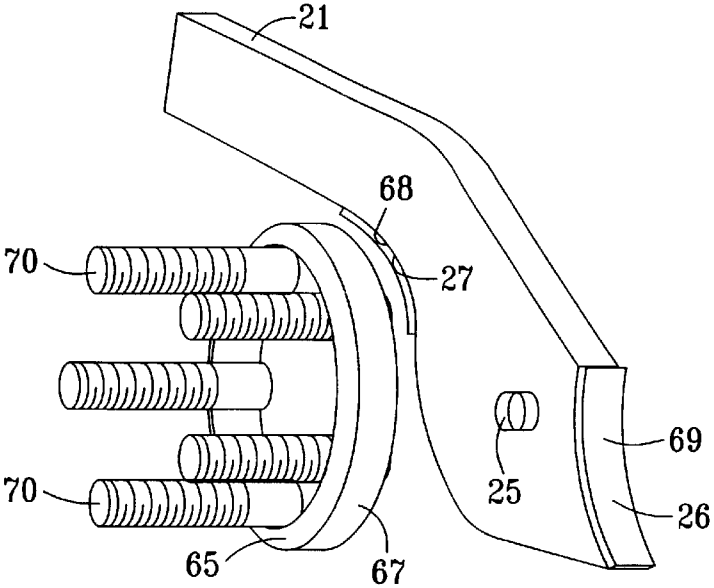
FIG. 8 is a perspective view of the brake lever and brake drum assembly of FIG. 7.
Figure 9:
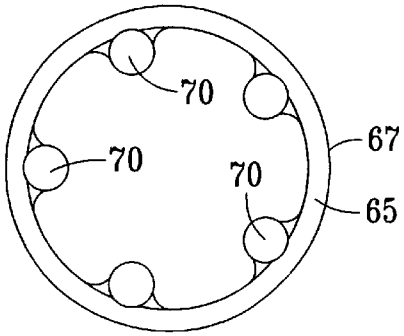
FIG. 9 is a side view of the brake drum assembly of FIG. 7.

The details of the brake drum and its attachment to a wheel such as wheel 34 is shown in FIGS. 7, 8 and 9. The tire portion 61 is supported by a wheel portion 66 which supports a bearing assembly 62. The brake drum member 65 has a brake contacting surface 67 which abuts abrasive pad 68 secured to a curved surface of brake member 22. A second abrasive pad 69 is connected to the second curved surface of brake member 22. Five attachment bolts 70 are welded or otherwise held to brake drum member 65. These are secured to wheel portion 66 by an epoxy or other adhesive 71. This provides a secure and compact braking system for the braking assembly of the present invention.

Figure 10:
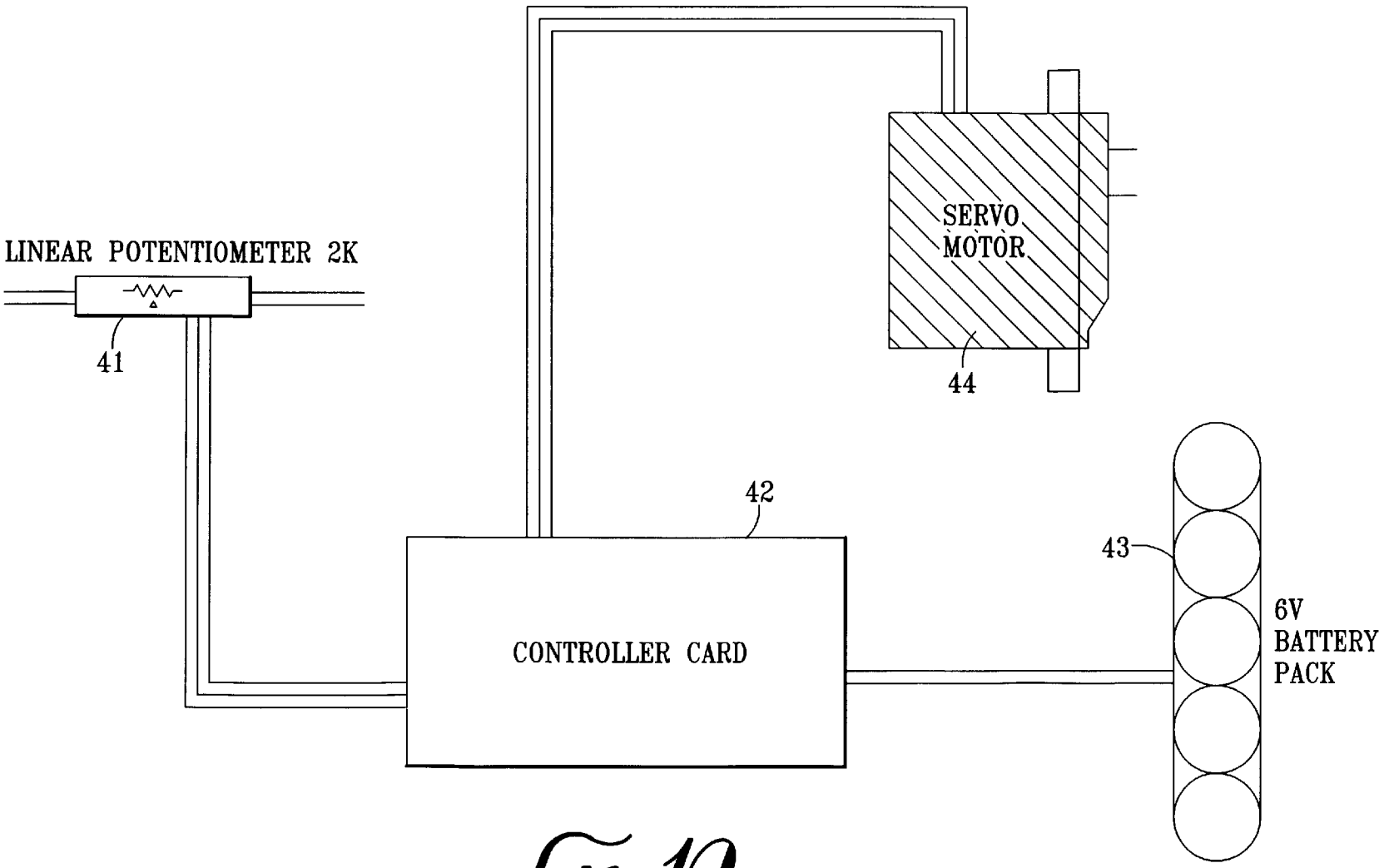
FIG. 10 is a diagrammatic view of the circuit of the electrically controlled brake of FIG. 4A through FIG. 6.

The diagrammatic view of the linear potentiometer 41, controller card 42, servo motor 44 and battery pack 43 is shown in FIG. 10 and is of a conventional design readily known to those skilled in the servo motor art. The potentiometer may also be controlled by a hand held wireless controller.

The braking assembly of the present invention provides a high degree of user control avoiding sudden stopping and instead providing a smooth controllable stopping action. The use of the electronic assist provides even further control.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A brake assembly for roller skates, said brake assembly comprising:

a wheel supporting frame holding at least two rotatable wheels aligned in a direction of travel of said wheel supporting frame, each of said at least two rotatable wheels having a bearing supported wheel portion and a tire portion and said wheel supporting frame holding a pivot member;

a brake member movably held by said pivot member, said brake member having a curved forward brake surface and a curved rear brake surface and an actuated arm; and a forward and a rear brake drum member held to at least one of said wheel portion and tire portion of each of said at least two rotatable wheels, said forward and rear brake drum members having a circular brake contacting area and said brake member and said forward and rear brake drum members being oriented to contact each other when said actuated arm is moved into a braking position.

2. The brake assembly of claim 1 further including a generally horseshoe shaped member having two ends and a rear ankle surrounding portion, said generally horseshoe shaped member being pivotally attached at two pivot points to a boot portion at the sides of said ankle surrounding area; and a link attached to a second area of said generally horseshoe shaped member so that as the generally horseshoe shaped member is pivotally moved back and forth, the link moves to and fro, said link being attached to said actuated arm of said brake member.

* * * * *